US005970970A

United States Patent [19]

Vanek et al.

[11] Patent Number: 5,970,970

[45] Date of Patent: Oct. 26, 1999

[54] RING AIRFOIL LAUNCHER

[75] Inventors: Chester F. Vanek, Sunnyvale; John W. Hunter, Poway; Abraham Flatau, Palo Alto; Thomas H. Grimm, Campbell; Sung H. Kim, Palo Alto; Robert B. Brownell, Jr., Santa Clara; William S. Law, Palo Alto; Mark C. Sorensen, Redwood City, all of Calif.

[73] Assignee: OddzOn, Inc., Pawtucket, R.I.

[21] Appl. No.: 09/010,431

[22] Filed: Jan. 21, 1998

Related U.S. Application Data

[63] Continuation-in-part of application No. 08/861,259, May 21, 1997, abandoned, and a continuation-in-part of application No. 08/907,544, Aug. 8, 1997

[60] Provisional application No. 60/050,663, Jun. 24, 1997, provisional application No. 60/050,777, Jun. 25, 1997, provisional application No. 60/018,107, May 22, 1996, and provisional application No. 60/023,828, Aug. 12, 1996.

[51] Int. Cl.[6] ..... F41B 7/00

[52] U.S. Cl. ..... 124/16; 124/81

[58] Field of Search ..... 124/16, 17, 20.1, 124/81

[56] References Cited

U.S. PATENT DOCUMENTS

| | | | |
|---|---|---|---|
| D. 279,492 | 7/1985 | Eddins et al. . | |
| D. 337,796 | 7/1993 | Sutyak | D21/145 |
| D. 360,439 | 7/1995 | Lewinski | D21/147 |
| D. 360,914 | 8/1995 | Brown | D21/147 |
| D. 361,105 | 8/1995 | Griffin | D21/147 |
| D. 368,280 | 3/1996 | Brown . | |
| 2,474,054 | 6/1949 | Jones . | |
| 2,784,711 | 3/1957 | Vaughn . | |
| 3,232,285 | 2/1966 | Rasner . | |
| 3,264,776 | 8/1966 | Morrow . | |
| 3,877,383 | 4/1975 | Flatau . | |
| 3,898,932 | 8/1975 | Flatau et al. . | |
| 3,951,070 | 4/1976 | Flatau et al. . | |
| 3,982,489 | 9/1976 | Flatau et al. . | |
| 4,003,574 | 1/1977 | MacDonald et al. . | |
| 4,151,674 | 5/1979 | Klahn et al. . | |
| 4,154,012 | 5/1979 | Miller . | |
| 4,246,721 | 1/1981 | Bowers . | |
| 4,291,663 | 9/1981 | Buck et al. . | |
| 4,390,148 | 6/1983 | Cudmore . | |
| 4,737,128 | 4/1988 | Moormann | 446/46 |
| 4,790,788 | 12/1988 | Hill | 446/61 |
| 4,892,081 | 1/1990 | Moormann | 124/65 |
| 4,957,092 | 9/1990 | Rhodes | 124/20.1 |
| 5,113,842 | 5/1992 | Moormann | 124/65 |
| 5,115,794 | 5/1992 | Moormann | 124/65 |
| 5,213,089 | 5/1993 | DeLuca | 124/29 |
| 5,224,464 | 7/1993 | Burnham et al. | 124/67 |
| 5,224,701 | 7/1993 | Sciarrillo et al. . | |
| 5,267,549 | 12/1993 | Webber | 124/65 |
| 5,377,656 | 1/1995 | Lewinski et al. | 124/65 |
| 5,397,261 | 3/1995 | Malewicki et al. | 446/71 |
| 5,438,972 | 8/1995 | Harbin | 124/27 |
| 5,447,144 | 9/1995 | Ivy | 124/26 |
| 5,531,210 | 7/1996 | Meiser et al. | 124/66 |
| 5,535,729 | 7/1996 | Griffin et al. | 124/66 |

*Primary Examiner*—John A. Ricci
*Attorney, Agent, or Firm*—Kolisch Hartwell; Dickinson McCormack & Heuser

[57] ABSTRACT

Toys and methods for safely and reproducibly launching ring airfoils in a flying orientation. The toys generally comprise a member, a ring airfoil support mounted on the member, and a propelling element configured to move the ring airfoil support along the member from a first to a second position. Contact between the ring airfoil and the ring airfoil support causes the ring airfoil to move with the ring airfoil support as the ring airfoil support moves; this contact is overcome as the ring airfoil support decelerates at the second position, causing the ring airfoil to be launched with forward or both forward and spinning motion. The toys further may comprise a housing to protect the toy and user, a return element to place the toy in an engaged, launch-ready configuration, and a trigger to hold the toy in the engaged configuration until launching. As an additional aspect of the invention, components of the device may be chosen so that the characteristics of the ring airfoil at launch are within certain safety limitations.

64 Claims, 10 Drawing Sheets

RING AIRFOIL LAUNCHER

CROSS REFERENCE TO RELATED APPLICATIONS

This application is a continuation-in-part of the following U.S. patent applications, each of which is incorporated herein by reference: Ser. No. 08/861,259, filed May 21, 1997, now abandoned and Ser. No. 08/907,544, filed Aug. 8, 1997. In addition, this application is based upon and claims the benefit under 35 U.S.C. § 119 of the following U.S. Provisional Applications, each of which is incorporated herein by reference: Ser. No. 60/050,663, filed Jun. 24, 1997; and Ser. No. 60/050,777, filed Jun. 25, 1997. This application also incorporates by reference the following U.S. provisional applications: Ser. No. 60/018,107, filed May 22, 1996; and Ser. No. 60/023,828, filed Aug. 12, 1996.

TECHNICAL FIELD

This invention relates generally to devices and methods for launching projectiles. More particularly, it relates to devices and methods for launching ring airfoil projectiles in a flying orientation that generates lift. This lift causes ring airfoils to follow a nearly level trajectory having a longer flight time than characterizes standard ballistic motion.

BACKGROUND OF THE INVENTION

Flying toys are popular amusement devices that include boomerangs, flying discs, kites, model airplanes, and ring airfoils. The popularity of flying toys arises in part because flying toys generate lift as they move through the air, giving them interesting and engaging flight characteristics.

Ring airfoils are relatively obscure flying toys that generally resemble hollow cylinders having open ends. The walls of these cylinders may have an airfoil shape. Ring airfoils "fly" when they generate lift by moving through the air in a flying orientation. In a preferred flying orientation, one end of the ring airfoil points generally forward, in the direction of motion, and the other end points generally backward. Lift generated in this and other flying orientations, combined with low aerodynamic drag, causes ring airfoils to follow nearly level trajectories. In contrast, nonflying toys, such as balls, follow parabolic ballistic trajectories. Nearly level trajectories ensure greater flight times than ballistic trajectories, enhancing the fun of playing with ring airfoils.

Ring airfoils also may spin during flight about a central axis or axis of symmetry connecting their two ends. Such spinning may gyro-stabilize the flying orientation of ring airfoils, helping them to maintain lift.

Although ring airfoils have been known for many years, they have failed to achieve the popularity of other flying toys. This failure may be due in part to difficulties inherent in inducing ring airfoils to move through the air in a flying orientation, and in part to safety concerns inherent in past patterns of use.

Launching by hand is the generally known method of launching ring airfoils, where launching generally comprises inducing a ring airfoil to move through the air. Most known ring airfoils were designed to be launched by hand, including those disclosed in U.S. Pat. Nos. 3,264,776, 4,151,674, 4,246,721, 4,390,148, 4,790,788, and 5,397,261. Yet, launching ring airfoils by hand has numerous shortcomings. First, launching by hand effectively may place the use of ring airfoils outside the ability of casual players, or of children in general, because considerable skill and/or strength may be necessary to provide both the forward and spinning motions needed to maintain ring airfoils in a flying orientation. Second, launching by hand raises safety concerns, because ring airfoils may be launched along errant paths or with too much energy, increasing the likelihood of damaging impacts. Third, launching by hand necessitates the use of rigid, rather than flexible, ring airfoils. Yet, flexible ring airfoils pose a lesser impact hazard than rigid ring airfoils. Moreover, flexible ring airfoils may better maintain their airfoil properties in use because they are less likely to be damaged by impacts and more likely to be aerodynamically self-stabilizing when spun.

Toys for mechanically launching projectiles having apertures also are known, including launchers disclosed in U.S. Pat. Nos. 3,232,285, 4,291,663, and 5,438,972. However, none of these toy launchers is designed for use with ring airfoils, and especially with flexible ring airfoils. Instead, these launchers are designed for use with rings ('285), balls ('663), and discs ('972).

These launchers generally engage and contact projectiles having apertures along the entire surface of such apertures. This contact creates frictional forces that must be overcome at launching, reducing the velocity with which projectiles leave the launchers and necessitating the use of more powerful launchers. Moreover, one launcher ('972) additionally engages projectiles with magnetic forces that also must be overcome at launching.

These launchers have other shortcomings. One ('972) has no mechanism to secure the launcher in a launch-ready, engaged configuration. Two ('285, '972) have no mechanism to spin a projectile. Yet, spinning the projectile is a desirable feature with ring airfoils, because spinning gyro-stabilizes flight. At least two ('285, '663) have exposed parts that may cause injury or be damaged during use. All three have no mechanism to place the launcher in an engaged configuration, except by pulling the projectile itself or the moving parts of the launcher. Yet, pulling the projectile itself requires that the projectile be rigid, and pulling the moving parts of the launcher requires that the moving parts be exposed, raising the safety concerns discussed above.

SUMMARY OF THE INVENTION

The present invention addresses these and other shortcomings by providing toys and methods for safely and reproducibly launching ring airfoils in a flying orientation.

The toys for launching a ring airfoil generally comprise a member, a ring airfoil support mounted on the member, and a propelling element configured to move the ring airfoil support along the member from a first position to a second position. Contact between the ring airfoil support and the ring airfoil causes the ring airfoil to move with the ring airfoil support as the ring airfoil support moves; this contact is overcome as the ring airfoil support decelerates at the second position, causing the ring airfoil to be launched. The toys reproducibly launch ring airfoils in flying orientations, eliminating the need for considerable skill and/or strength to induce ring airfoils to display their unique flying characteristics.

The member helps to guide the ring airfoil support as it is moved by the propelling element between the first and second positions. The member determines the direction of launch and helps to ensure that ring airfoils are not launched in errant directions. The member may have a channel disposed along a portion of its length, and this channel may extend helically about the member, so that the ring airfoil will leave the launcher with both forward and gyro-stabilizing spinning motion. The member also may be substantially cylindrical between the first and second positions.

The ring airfoil support contacts and supports the ring airfoil, communicating the motion of the ring airfoil support to the ring airfoil so that the ring airfoil may be launched. The ring airfoil support may include a first support structure adapted to contact an inner surface of the ring airfoil, through which contact the first support structure may support a flexible ring airfoil. The first support structure may include ribs to support further the ring airfoil, while minimizing frictional contact that will reduce launch velocity and necessitate a more powerful launcher. The ring airfoil support further may include a second support structure adapted to contact a trailing edge of the ring airfoil to prevent the ring airfoil from sliding off the ring airfoil support during launching. The second support structure may include a surface oriented substantially perpendicular to an axis connecting the first and second positions.

The propelling element moves the ring airfoil support between the first and second positions. As discussed above, use of a ring airfoil support that includes ribs may allow use of a less powerful propelling element. As a consequence, less strength will be required to use the launcher, which is especially advantageous for children. The propelling element may take the form of a spring.

The toy further may include a housing that substantially encloses the member and ring airfoil support between the first and second positions. Such a housing will protect the toy from damage and prevent users from being injured by moving parts. At least a portion of the housing may be movable relative to the member so that the ring airfoil may be loaded more easily onto the ring airfoil support. The housing also may be constructed to permit visual determination of whether the ring airfoil support contains a ring airfoil or is in the launch configuration without looking into the launcher along the launch direction.

The toy further may include a return element separate from the ring airfoil support and configured to move the ring airfoil support along the member from the second position to the first position. The return element permits users to place the launcher in an engaged configuration without pulling the projectile itself or the moving parts of the launcher. The return element also permits a housing to cover the moving parts of the launcher, protecting both the launcher and the user. The return element may take the form of a movable handle, which may remain stationary during launch.

The toy further may include a trigger to hold the ring airfoil support in the first position, and to release the ring airfoil support to permit the ring airfoil support to move along the member to the second position.

As an additional aspect of the invention, components of the toy may be chosen so that the characteristics of the ring airfoil at launch are within certain safety limitations. This is made possible by the reproducible nature of a mechanical launcher. For example, the propelling element may be chosen so that the kinetic energy associated with the forward motion of the ring airfoil is no more than 1.0 joule, or the kinetic energy density of the ring airfoil at point-blank impact is no more than 3,000 joules per square meter, or the spin rate of the ring airfoil is no more than 2,000 revolutions per minute. Moreover, the ring airfoil support may be chosen to support in a substantially symmetric configuration flexible ring airfoils having durometer readings of no more than 80 on the Shore A scale, or to exclude relatively small ring airfoils having an outer diameter of less than 1.5 inches.

The ring airfoil launcher further may include a safety element configured to limit the ability of the launcher to launch non-ring airfoil projectiles. This safety element may take the form of an aperture, a tacky material, or a flap, among others.

The methods of launching a ring airfoil provided by the present invention generally comprise providing a ring airfoil launcher configured to accommodate the ring airfoil, loading the ring airfoil onto the ring airfoil launcher so that the inner surface of the ring airfoil contacts the ring airfoil launcher, storing energy in the ring airfoil launcher, and transferring at least a portion of the energy stored in the ring airfoil launcher to the ring airfoil, causing the ring airfoil to be launched from the ring airfoil launcher with forward motion. The step of storing energy further may include pulling a handle. The step of transferring energy may cause the ring airfoil to be launched with both forward and gyro-stabilizing spinning motion. In addition, the methods further may comprise the steps of engaging a trigger to hold the ring airfoil launcher in a first configuration, in which energy is stored, and releasing the trigger to permit the ring airfoil launcher to relax to a second configuration and transfer energy to the ring airfoil.

As an additional aspect of the invention, steps of the methods may be chosen so that the characteristics of the ring airfoil at launch are within the safety limitations discussed above.

The nature of the present invention will be more readily understood after consideration of the drawings and the detailed description of the preferred embodiment that follow.

DETAILED DESCRIPTION OF THE PREFERRED EMBODIMENT AND BEST MODE OF CARRYING OUT THE INVENTION

The ring airfoil launcher provided by the present invention generally comprises a member, a ring airfoil support mounted on the member and adapted to contact a ring airfoil, and a propelling element configured to move the ring airfoil support along the member from a first position to a second position. The ring airfoil launcher may combine these and additional elements to provide embodiments that easily, safely, and reproducibly launch ring airfoils.

Figure 1:
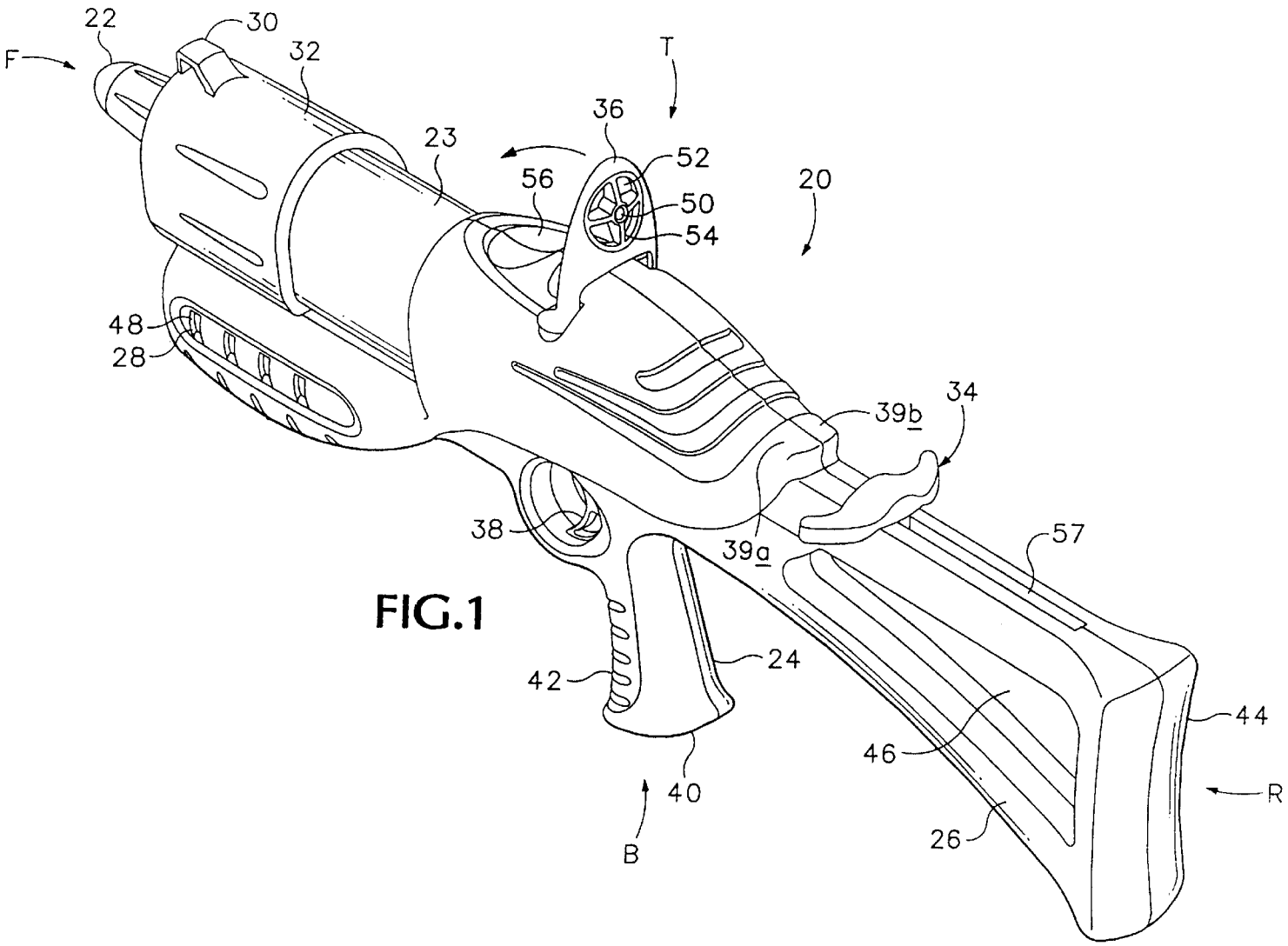
FIG. 1 is a perspective view of a ring airfoil launcher constructed in accordance with the present invention.

FIG. 1 shows a preferred embodiment of a ring airfoil launcher 20 constructed in accordance with the present invention. Generally, the exterior form of the launcher is chosen to make the launcher durable, attractive, and easy to use. The launcher is designed so that its exterior form may be changed readily. The form shown in FIG. 1 gives the launcher a futuristic look, but other motifs also could be employed, such as the 19th Century "Wild West."

Launcher 20 has a generally elongate form, with forward and rear ends F, R and top and bottom sides T, B. Unmovable exterior elements of launcher 20 include a nose 22, a window 23 for viewing selected interior parts of the launcher, a hand grip 24 and butt 26 for holding and positioning the launcher, and bays 28 for storing ring airfoils. Movable exterior elements of launcher 20 include a front sight 30, a muzzle 32 for presenting front sight 30 and for covering selected moving parts of the launcher, a handle 34 for "cocking" the launcher, a rear sight 36 for aiming the launcher, and a trigger 38 for "firing" the launcher. Here, cocking refers to storing energy in the launcher, and firing refers to releasing that energy to launch a ring airfoil.

Exterior elements of launcher 20 are arranged to optimize function and convenience. Nose 22, window 23, bays 28, front sight 30, and muzzle 32 are located generally near forward end F; butt 26 and handle 34 are located generally near rear end R; and hand grip 24, rear sight 36, and trigger 38 are located generally about midway between forward and rear ends F, R. Similarly, front sight 30, handle 34, and rear sight 36 are located generally near top side T; hand grip 24, bays 28, and trigger 38 are located generally near bottom side B; and nose 22, window 23, butt 26, and muzzle 32 are located generally about midway between top and bottom sides T, B.

Collectively, the elements listed above, excluding nose 22, handle 34, and trigger 38, comprise a housing for the launcher. This housing may be formed in part as two joinable shells 39*a, b* having approximately mirror-image symmetry, to which window 23, muzzle 32, and rear sight 36 may be added. In the assembled launcher, the housing largely surrounds the moving parts of launcher 20, which contact and move the ring airfoil during launching, preventing injury to the user and damage to the parts. Various different housings may be employed, including a rifle, pistol, blowgun, and bow and arrow, among others.

Hand grip 24 and butt 26 are elongate projections that may be used generally to grip and position the launcher. Hand grip 24 may be formed with a widened distal end 40 and indentations 42 to facilitate gripping the launcher. Butt 26 also may be formed with a widened distal end 44 and indentations, as well as an aperture 46, to facilitate gripping the launcher or tucking it under an arm.

Bays 28 are cavities on the bottom of launcher 20 that may be used generally to store ring airfoils prior to launching. To store a ring airfoil in a bay, a user simply compresses the ring airfoil and then slips it into the bay through an access slot 48. Once inside the bay, the ring airfoil expands against the walls of the bay, forming frictional contacts that hold the ring airfoil snugly but yieldingly in place. To remove a ring airfoil from a bay, a user simply pulls the ring airfoil back through access slot 48.

Rear sight 36 is a projection on top of launcher 20 that may be used generally to aid the eye in aiming the launcher. More specifically, rear sight 36 provides a hollow tube 50 that may be sighted through and aligned with a target before firing the launcher. Hollow tube 50 is located in an aperture 52 in rear sight 36 and is supported by crosshairs 54. Rear sight 36 may be designed to pop off easily if impacted and to be easy to reinstall. Rear sight 36 also may be converted conveniently between an upright orientation for use in which the rear sight extends away from the launcher, and a folded orientation for storage in which the rear sight extends along the length of the launcher. A receiving chamber 56 may be provided to receive rear sight 36 when it is in the folded orientation. In FIG. 1, rear sight 36 is shown in the upright orientation.

Front sight 30 is a projection on top of muzzle 32 whose primary function is cosmetic. However, front sight 30 also could be used to actuate the muzzle, as described below, or to aim the launcher in conjunction with rear sight 36 if front sight 30 were increased in size.

Additional exterior elements of launcher 20 are described in detail below in connection with their functions in cocking, loading, and/or firing the launcher.

Figure 2:
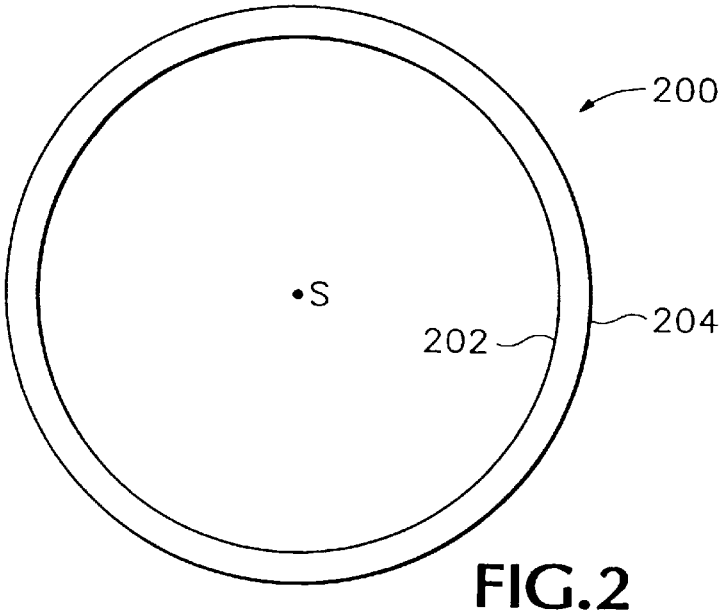
FIG. 2 is a front view of a ring airfoil for use with the ring airfoil launcher of FIG. 1.
Figure 3:
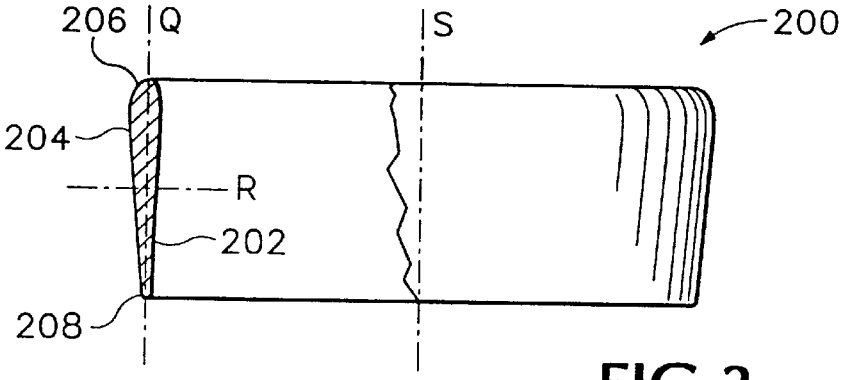
FIG. 3 is a side view of the ring airfoil shown in FIG. 2, where a portion of the ring airfoil has been cut away to show a cross-section of the wall of the ring airfoil.
Figure 4:
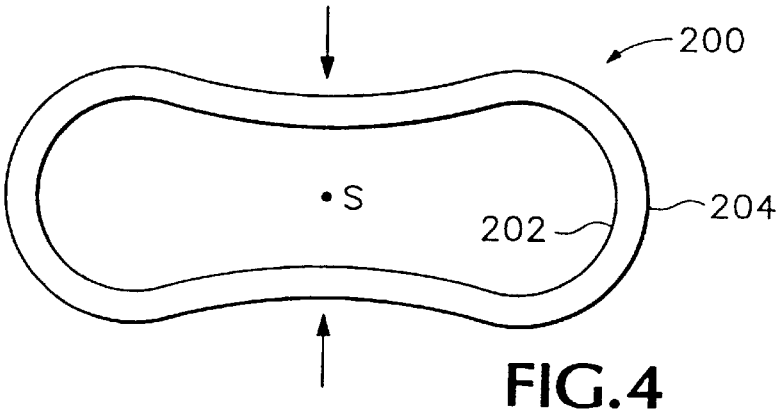
FIG. 4 is a front view of the ring airfoil shown in FIG. 2, where the ring airfoil has been compressed by compression forces to demonstrate the flexibility of ring airfoils in some embodiments.

FIGS. 2–4 show a ring airfoil 200 suitable for launching by ring airfoil launcher 20. Ring airfoils generally comprise hollow, annular bodies having inner and outer surfaces 202, 204 and leading and trailing edges 206, 208. Ring airfoils may resemble cylinders open at both ends. The walls of these cylinders may have an airfoil cross section, like that of an airplane's wing. This cross section may be asymmetric about a centerline Q bisecting leading and trailing edges 206, 208. Moreover, this cross section also may be asymmetric about a centerline R bisecting inner and outer surfaces 202, 204. Whether symmetric or asymmetric, ring airfoils have an inherently rounded shape that enhances their safety in use.

Ring airfoil 200 may be formed in various ways from various materials. In one embodiment, the ring airfoil is injection molded from a thermoplastic elastomer. In this embodiment, the ring airfoil is substantially flexible, reducing impact hazards to humans, objects, and the ring airfoil itself This flexibility also may make the ring airfoil self-stabilizing if spun about a center axis S, because spinning will bias the ring airfoil into a substantially symmetric configuration. This is true even if the ring has taken a noncircular shape due to production variability, improper storage, or other environmental causes. An ability to launch flexible ring airfoils is a significant feature of launcher 20.

FIG. 4 shows a flexible ring airfoil that has been compressed by compression forces acting on opposite sides of outer surface 204. These forces are indicated in the figure by arrows. Elastic or other restoring forces may tend to restore compressed ring airfoils to a substantially symmetric configuration after such compression forces are terminated.

Safety concerns may partially determine the preferred physical properties of ring airfoil 200. For example, the mass may be limited to no more than 7.5 grams, the diameter to no less than 1.5 inches, or the hardness to no more than 80 measured on the Shore A scale. Such limits on mass and hardness will reduce the sting associated with impacts, and such limits on size will reduce the likelihood of substantial impact with an eye. The preferred physical properties of the ring airfoil also may be limited expressly by ASTM, EN71, and other safety standards regarding kinetic properties of projectiles upon launching, including their kinetic energy and kinetic energy density. Kinetic limitations are discussed below.

Figure 5:
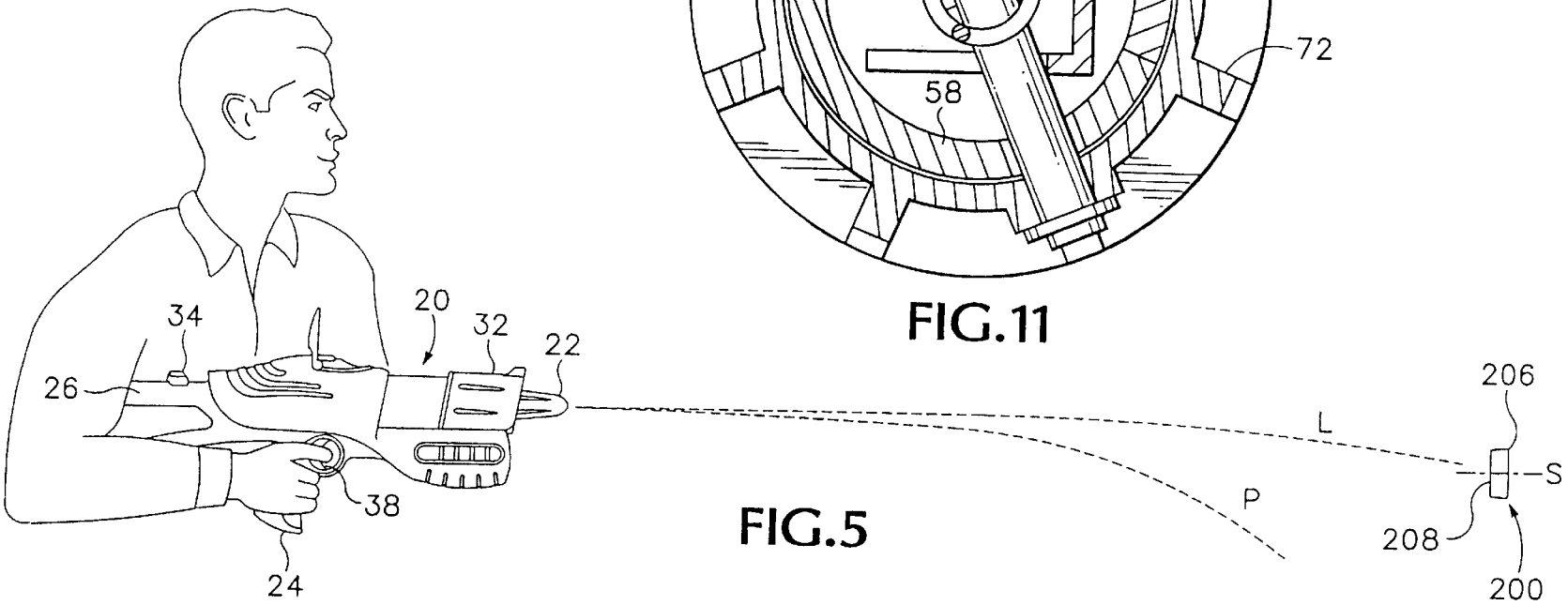
FIG. 5 is a side elevation view of the ring airfoil launcher of FIG. 1 in use, showing how the flying trajectory of the ring airfoil differs from the ballistic trajectory of normal projectiles.

FIG. 5 shows ring airfoil launcher 20 in use. The launcher is cocked by pulling handle 34 away from nose 22 until trigger 38 is engaged. Handle 34 travels along a slot 57 in the housing that is visible in FIG. 1. The launcher is loaded by pulling muzzle 32 away from nose 22 to reveal a ring airfoil support and then sliding a ring airfoil over the nose until it contacts the ring airfoil support. Biasing mechanisms return handle 34 and muzzle 32 to their original positions when they are released. The launcher is fired by holding it using hand grip 24 and butt 26, aiming it in a desired direction, and pulling trigger 38.

The ring airfoil may be launched for accuracy or distance, among other applications. For example, launching for accuracy might involve trying to hit a target with the ring airfoil. Launching for distance might involve trying to shoot a long distance by optimizing the launch angle. Maximum range generally is obtained at a smaller launch angle for ring airfoils than for nonflying projectiles.

If a ring airfoil is launched in certain orientations, it will "fly" along a nearly level trajectory rather than fall along a parabolic ballistic trajectory. This flight characteristic is a consequence of lift generated by air moving over the surfaces of the ring airfoil in a way that reduces air pressure on upper surfaces and/or increases air pressure on lower surfaces of the ring airfoil. In a preferred flying orientation, leading edge 206 of ring airfoil 200 points generally forward, in the direction of motion, and trailing edge 208 points generally backward. In addition, leading edge 206 may tilt upward slightly relative to trailing edge 208, such that center axis S through ring airfoil 200 makes a small angle relative to the horizontal. This angle will remain largely unchanged throughout the ring airfoil's trajectory.

Forward motion of ring airfoils also may be accompanied by spinning motion about center axis S. In addition to biasing the ring airfoil into a more symmetric configuration, such spinning gyro-stabilizes the flying orientation of ring airfoils, helping them to maintain lift.

The nearly level trajectories followed by flying ring airfoils are characterized by longer flight times than characterize standard ballistic trajectories, enhancing the fun of playing with ring airfoils. FIG. 5 qualitatively compares the nearly level flying trajectory L followed by a ring airfoil with the parabolic ballistic trajectory P followed by a nonflying projectile, where both projectiles were launched horizontally. The flight time t associated with an initially horizontal ballistic trajectory is given by the expression $t=[2h/g]^{1/2}$, where h is the vertical distance through which the projectile falls before impact, and g is the acceleration due to gravity, or approximately 9.8 meters per second squared. Thus, the flight time for a nonflying projectile launched horizontally from a height of about 1.2 meters (4 feet) will be about 0.50 seconds. The flight time for a ring airfoil launched horizontally from the same height will be at least this long, because lift forces effectively will reduce g in the above expression for flight time.

Figures 6, 7:
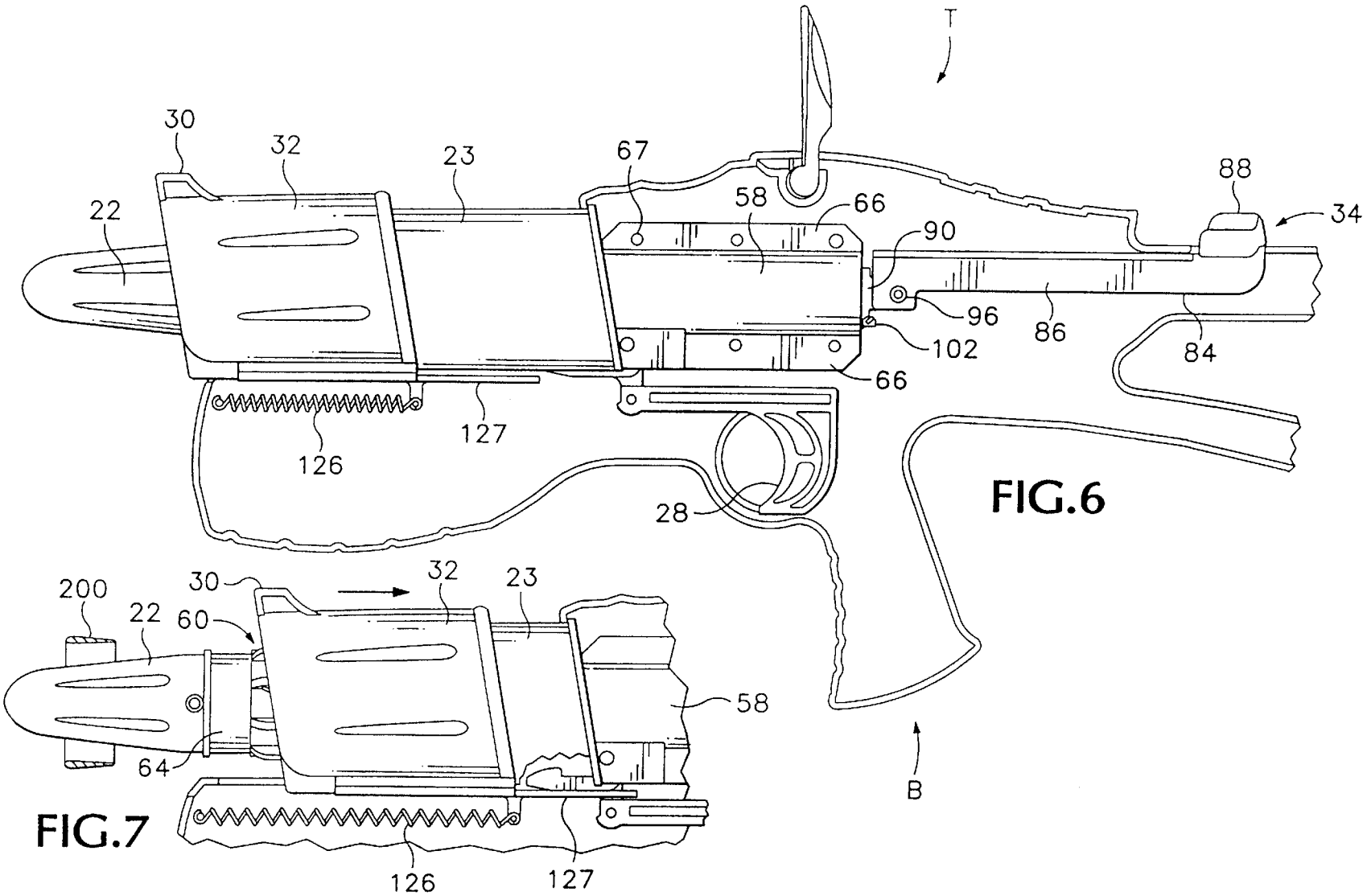
FIG. 6 is a fragmentary side elevation view of the ring airfoil launcher shown in FIG. 1, in which one side of the housing for the launch mechanism has been removed.
FIG. 7 is a detailed view of the forward end of the ring airfoil launcher shown in FIG. 6, showing the muzzle in an alternative configuration.

FIGS. 6–12 show the elements and operation of the launch mechanism of launcher 20. The launch mechanism generally comprises portions of launcher 20 directly involved in loading, cocking, and firing the launcher. The launch mechanism mounts within muzzle 32, window 23, and the two halves of the housing 39*a, b*, as shown in FIG. 6. Significant elements visible in the figures include a member 58, a ring airfoil support 60, a propelling element 62 and associated bumper 64, a handle 34, and a trigger 38. These elements are discussed below, in turn.

Figure 10:
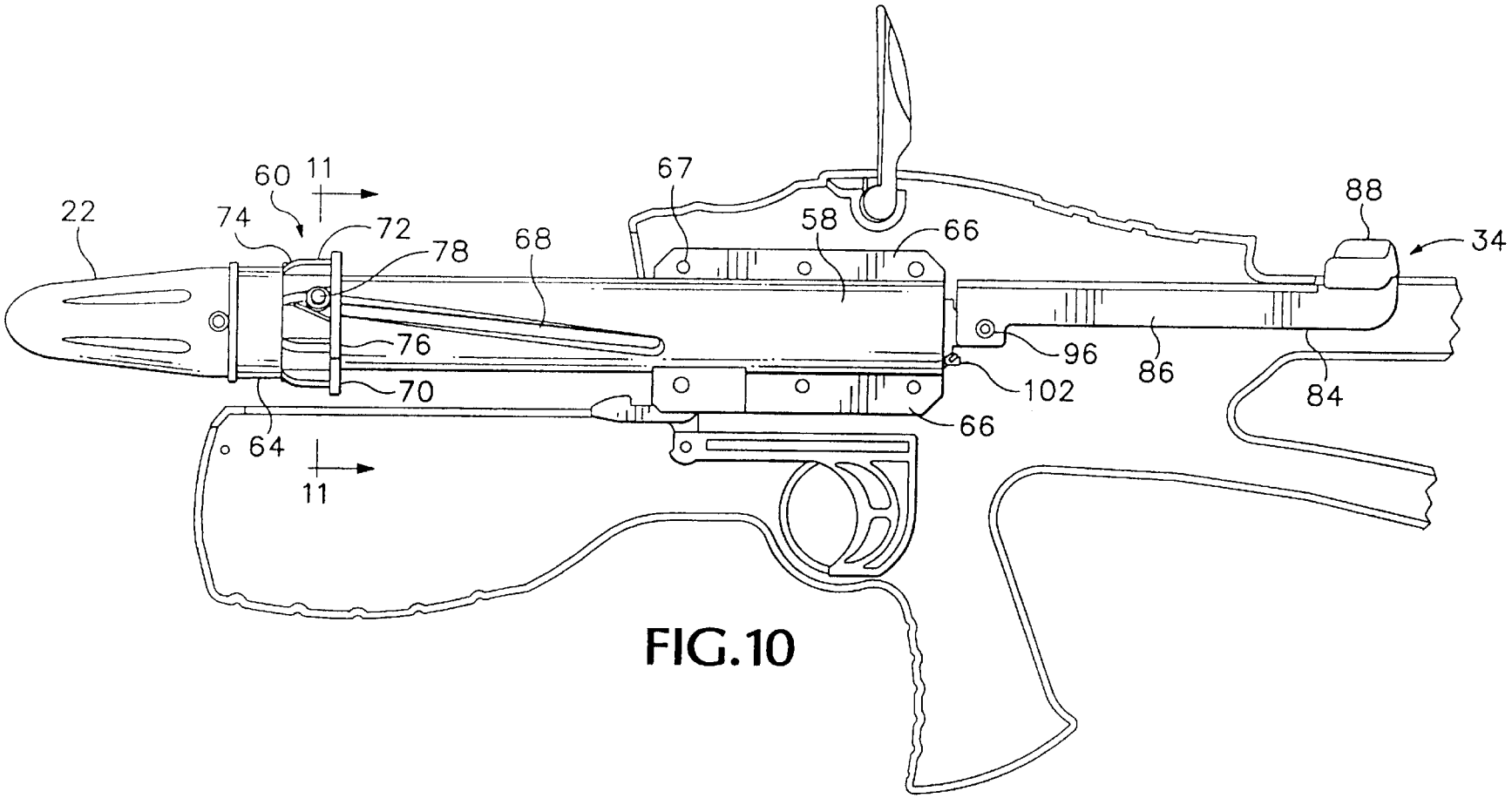
FIG. 10 is a fragmentary side elevation view of the ring airfoil launcher shown in FIG. 6, in which additional components of the housing have been removed, showing the launcher in its "fired" configuration.
Figure 12:
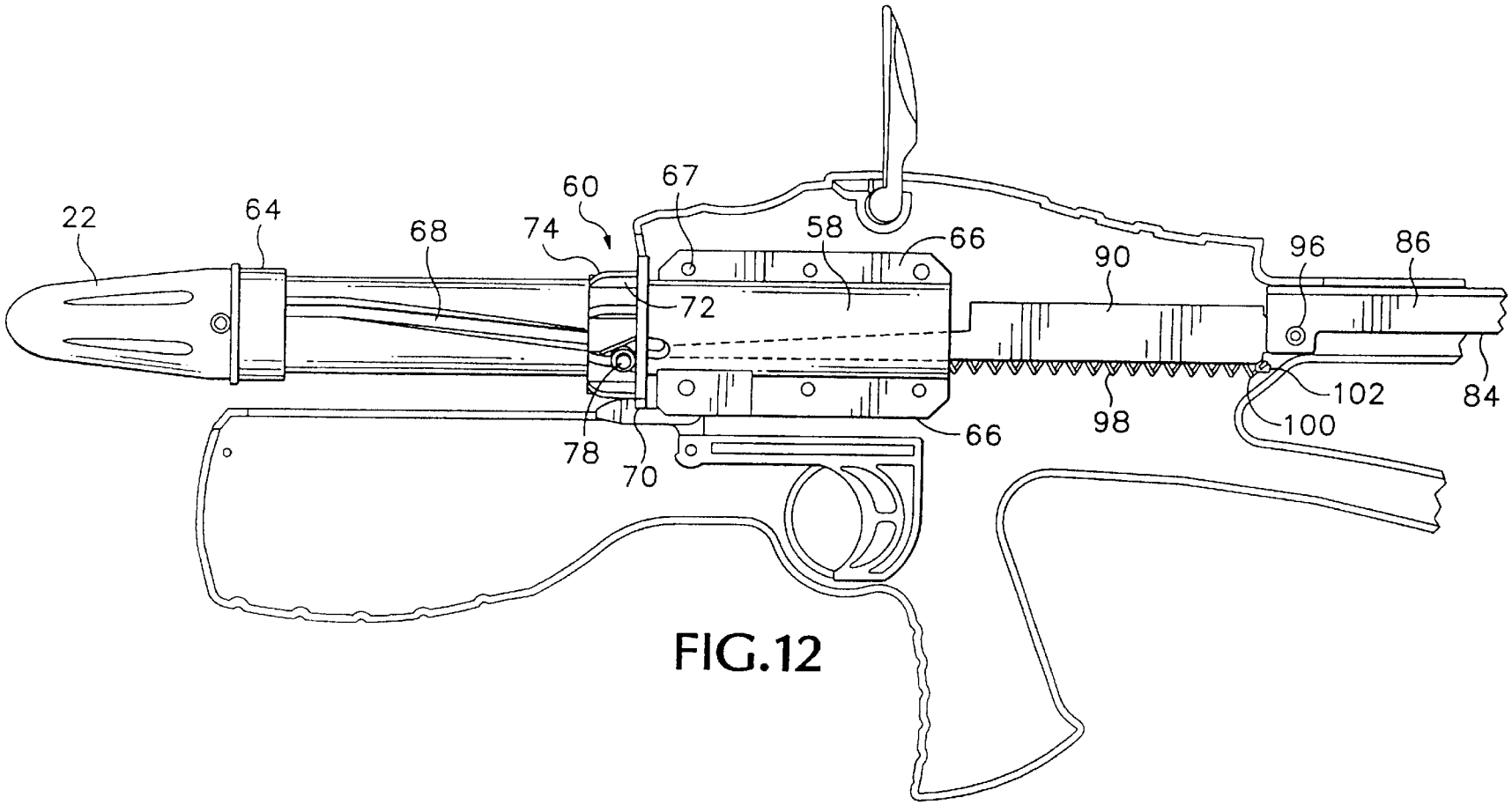
FIG. 12 is a fragmentary side elevation view of the ring airfoil launcher shown in FIG. 10, showing the launcher in its "cocked" configuration.

Member 58 helps to guide the motion of ring airfoil support 60 (and hence the ring airfoil) during launching and thereby determines the direction in which the ring airfoil is launched. Member 58 is best seen in FIGS. 10 and 12. Member 58 may take a number of forms. In launcher 20, member 58 is elongate and substantially cylindrical, with flanges 66 along a portion of the member's length that extend outward toward top and bottom T, B of the launcher. Holes 67 in these flanges are used to attach member 58 to the housing.

Like the housing, member 58 may be formed as two joinable parts having approximately mirror-image symmetry. These parts may be joined to one another in part using holes 67 in flanges 66.

Member 58 also may have a channel 68 disposed along at least a portion of its length. This channel may take a number of forms. In launcher 20, channel 68 takes the form of two helical slots disposed on opposite sides of member 58 and making about one-quarter turn along the length of the member.

Figure 11:
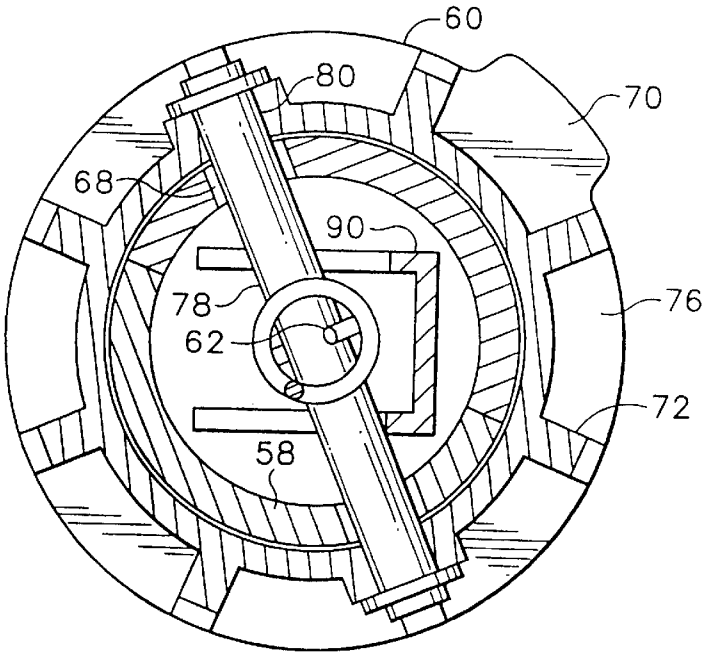
FIG. 11 is a front view of the ring airfoil suppolt, taken generally along line 11—11 in FIG. 10.

Ring airfoil support 60 contacts and supports the ring airfoil, communicating the motion of the ring airfoil support to the ring airfoil so that the ring airfoil may be launched. Ring airfoil support 60 is best seen in FIGS. 10–12 and may be termed a projectile support. Ring airfoil support 60 is mounted on member 58 and moves along the member during launching. Depending on the embodiment, the ring airfoil support may attach to the member along an exterior side of the ring airfoil support, or the ring airfoil support may receive the member through an aperture in the ring airfoil support. The latter configuration is shown in the figures.

Ring airfoil support 60 generally moves between two positions. FIG. 12 shows ring airfoil support 60 in its first position, which corresponds to the launch mechanism being in its "cocked" configuration. FIG. 10 shows ring airfoil support 60 in its second position, which corresponds to the launch mechanism being in its "fired" configuration.

The ring airfoil support may take a number of forms, as dictated by its interactions with the member. In launcher 20, ring airfoil support 60 has radial symmetry and receives member 58 through a substantially circular aperture that conforms to the member's substantially cylindrical shape. Ring airfoil support 60 also may have a tab 70 for engaging trigger 28.

Ring airfoil support 60 may have support structures adapted to contact and support a ring airfoil. For example, ring airfoil support 60 may have a first support structure adapted to contact the inner surface 202 of a ring airfoil and to maintain flexible ring airfoils in a substantially symmetric configuration. This first support structure also may be adapted to minimize contact between the ring airfoil and the launcher, reducing frictional contact that would otherwise slow the ring airfoil upon launching. In launcher 20, this first support structure takes the form of ribs 72 that extend outward substantially perpendicular to the long axis of member 58. These ribs may have sloped leading edges 74 to facilitate loading the ring airfoil on the ring airfoil support. Moreover, these ribs may be disposed around ring airfoil support 60 in sufficient number and with sufficient regularity so that flexible ring airfoils having a durometer reading of no more than 80 on the Shore A scale may be maintained in a substantially symmetric configuration through contact between the ribs and the inner surface of the ring airfoil. In addition, ribs 72 on opposite sides of ring airfoil support 60 may be sufficiently far apart so that even very thin ring airfoils cannot be loaded on the support if their outer diameter is less than 1.5 inches.

Ring airfoil support 60 also may have a second support structure adapted to contact the trailing edge 208 of the ring airfoil to prevent the ring airfoil from sliding off the ring airfoil support during launching. In launcher 20, this second support structure takes the form of a surface 76 oriented substantially perpendicular to the long axis of member 58. The ring airfoil may contact the second support structure during each launch, or the ring airfoil may contact the second support structure only if it is about to slide off the rear of the ring airfoil support.

Ring airfoil support 60 attaches to member 58 via a pin 78 that projects through bores 80 in the ring airfoil support and through channels 68 in the member to contact propelling element 62.

Figure 13:
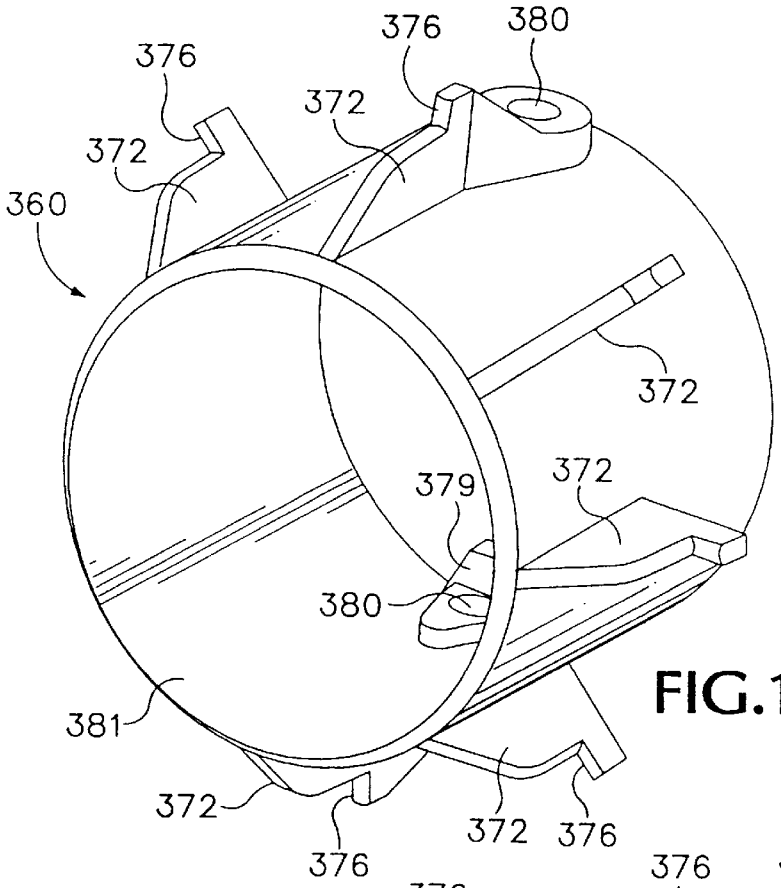
FIG. 13 is a front perspective view of an alternative embodiment of the ring airfoil support shown in FIG. 11.
Figure 14:
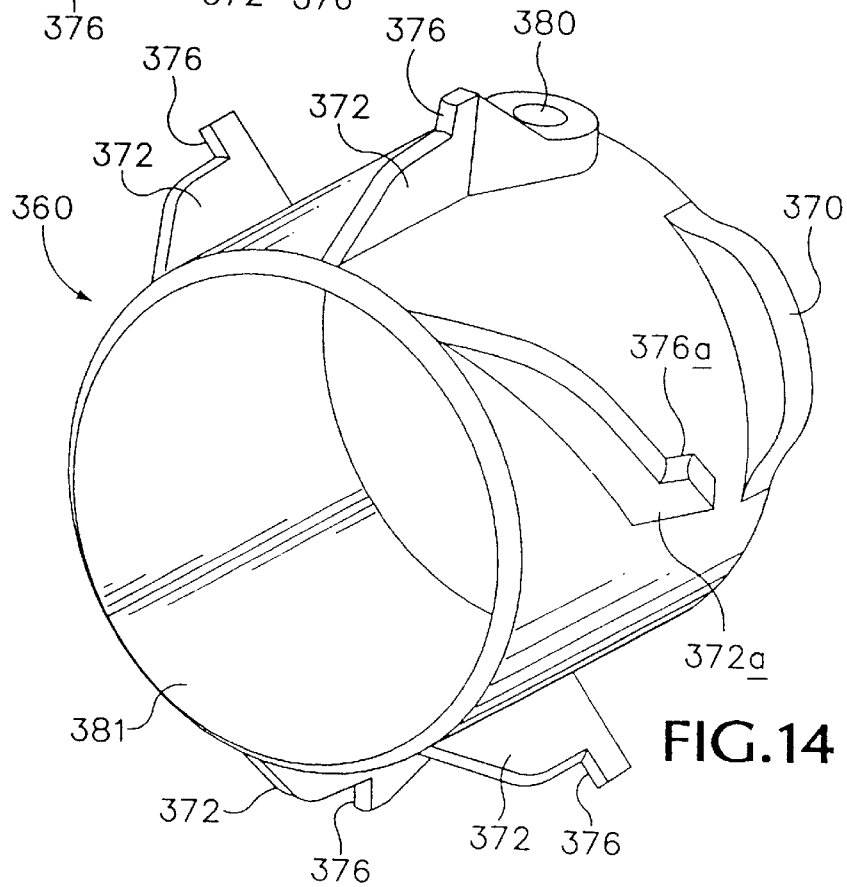
FIG. 14 is another front perspective view of the ring airfoil support shown in FIG. 13, where the generally cylindrical ring airfoil support has been rotated about its cylinder axis by about 180 degrees.
Figure 15:
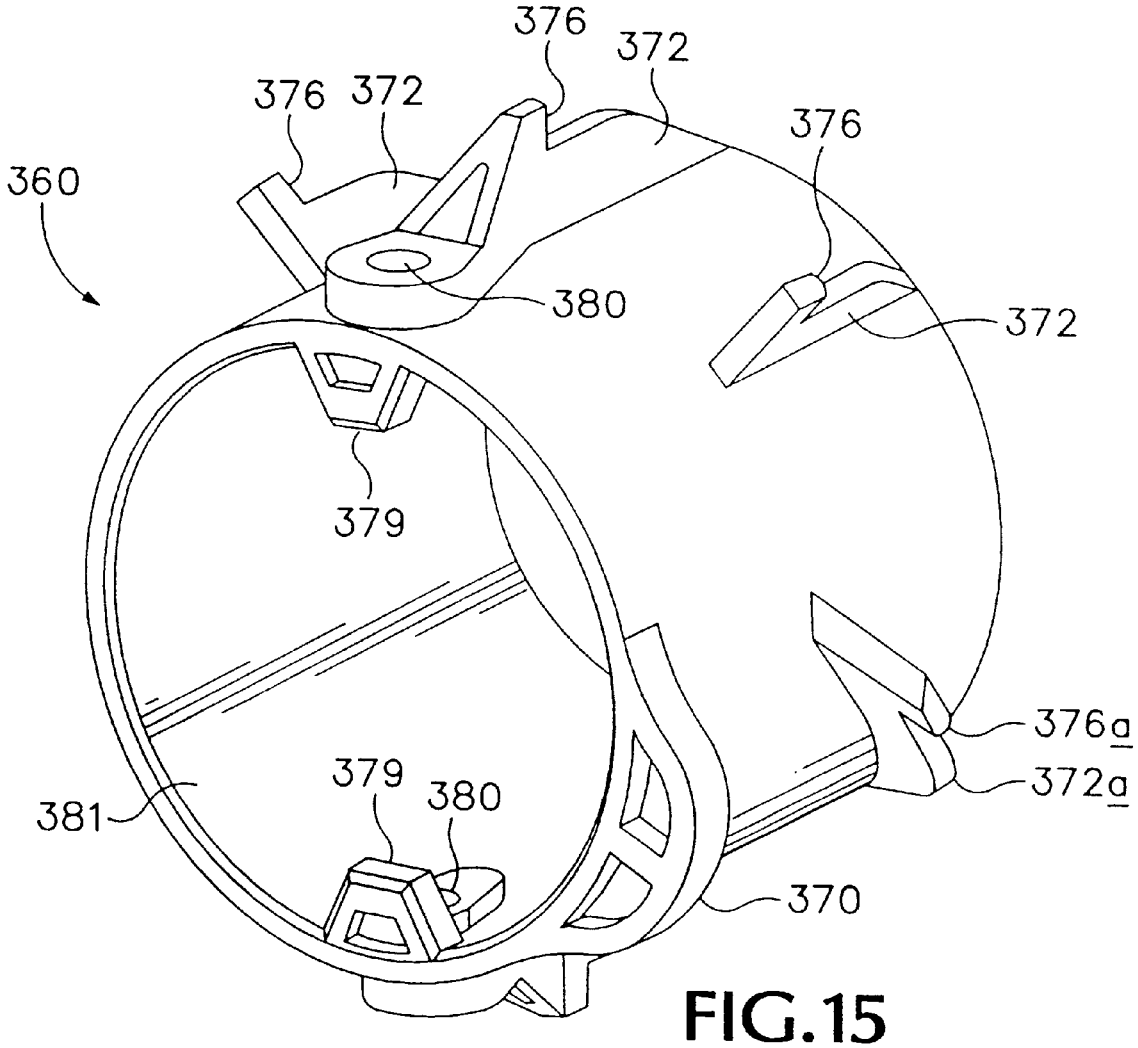
FIG. 15 is a rear perspective view of the ring airfoil support shown in FIG. 13.

FIGS. 13–15 show an alternative embodiment of the ring airfoil support. Generally, ring airfoil support 360 resembles ring airfoil support 60, having a substantially cylindrical shape with a tab 370 for engaging trigger 28, outwardly extending ribs 372 for supporting a ring airfoil, and bores 380 for receiving pin 78. Moreover, ribs 372 may have sloped leading edges 374 to facilitate loading the ring airfoil, as do ribs 72 in ring airfoil support 60.

In addition to these common features, ring airfoil support 360 has several special features that distinguish it from ring airfoil support 60. For example, ring airfoil support 360 has projections 379 adjacent bores 380 on the inside surface 381 of ring airfoil support 360 to engage channel 68 on member 58. In addition, ring airfoil support 360 has a single, outwardly extending helical rib 372*a* located adjacent tab 304. Most significantly, in ring airfoil support 360, the second support surface takes the form of backstops 376, 376*a* on ribs 372, 372*a* that are formed by outward extensions of the ribs themselves, rather than by a separate surface. Backstops 376 may be flat where they engage the trailing edge 208 of the ring airfoil, or they may be curved so that they contact the ring airfoil only along a line or at a single point. In contrast, in ring airfoil support 60, the second support surface takes the form of a surface 76 that extends completely around the ring airfoil support. These special features have important safety implications, as described below.

In other alternative embodiments of the invention, all of the ribs may be helical. For example, the pitch and handedness of the ribs may be chosen to match the pitch and handedness of channel 68 to minimize frictional contact between the ring airfoil and ring airfoil support upon launching at the second position. Handedness refers to whether the channel is configured to cause clockwise or counterclockwise rotation of the ring airfoil after launching.

Figure 8:
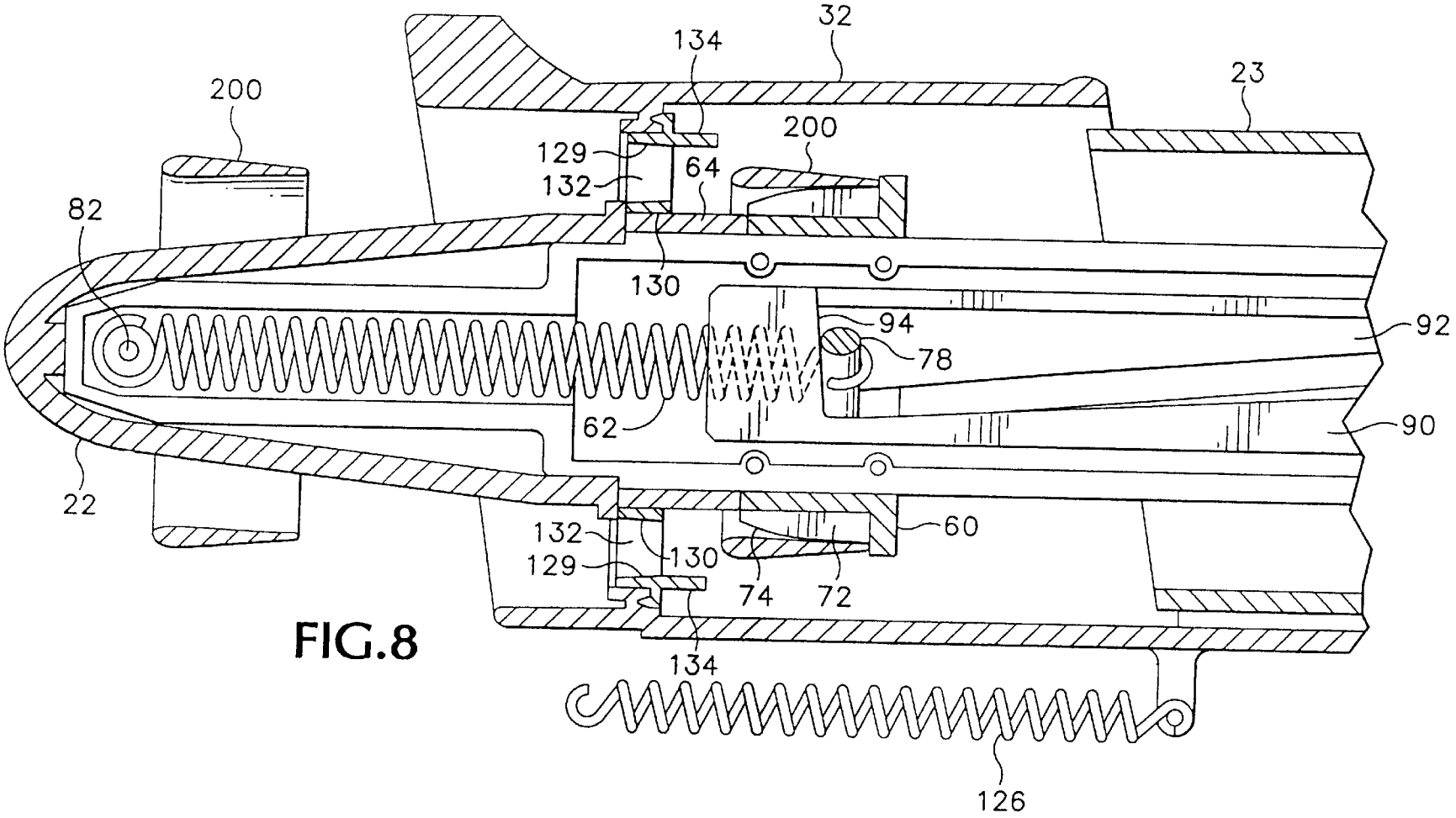
FIG. 8 is a first cross-sectional view of the ring airfoil launcher shown in FIG. 6, focusing on the propelling element of the launch mechanism.

Propelling element 62 is associated with ring airfoil support 60 and is configured to move the ring airfoil support along member 58. Such movement may involve acceleration and deceleration. Propelling element 62 is best seen in FIG. 8. In launcher 20, propelling element 62 takes the form of a spring having two ends, where one end is attached to a knob 82 inside the forward end of member 58 and the other end is attached to pin 78 as it passes through member 58.

The propelling element also may include a bumper 64 configured to decelerate the ring airfoil support at the second position. Bumper 64 is best seen in FIGS. 10 and 12. Bumper 64 is substantially annular and surrounds member 58 adjacent nose 22. Bumper 64 functions by blocking the path of ring airfoil support 60 and is formed of a material that is sufficiently resilient to withstand associated impacts.

Handle 34 comprises a movable return element that is separate from ring airfoil support 60 and that is configured to move ring airfoil support 60 along member 58. More specifically, handle 34 is configured to return the ring airfoil support to the cocked position from the fired position after launching. The handle is configured to permit a user to place the launcher in the cocked configuration without pulling on the ring airfoil or the moving parts of the launcher. This, in turn, permits the ring airfoils to be flexible and the moving parts of the launcher to be covered, conferring the advantages discussed above. Handle 34 is best seen in FIGS. 6, 8–10, and 12.

Handle 34 is formed of two pieces. Both handle pieces are elongate and mount with their long axes substantially parallel to member 58. A first handle piece 84 includes a first elongate bar 86 attached to a graspable pull 88. In the assembled launcher, first elongate bar 86 is mounted within the housing, and graspable pull 88 is mounted outside the housing, where it may be used to actuate the handle, as described below.

A second handle piece 90 includes a second elongate bar having a tapered aperture 92 for receiving pin 78, as shown in FIG. 8. Aperture 92 is configured so that contact between pin 78 and a forward edge 94 of the aperture may be used to stretch propelling element 62 and move ring airfoil support 60 along member 58 when the launcher is cocked. Stretching the propelling element stores energy that is released when the launcher is fired.

Figure 9:
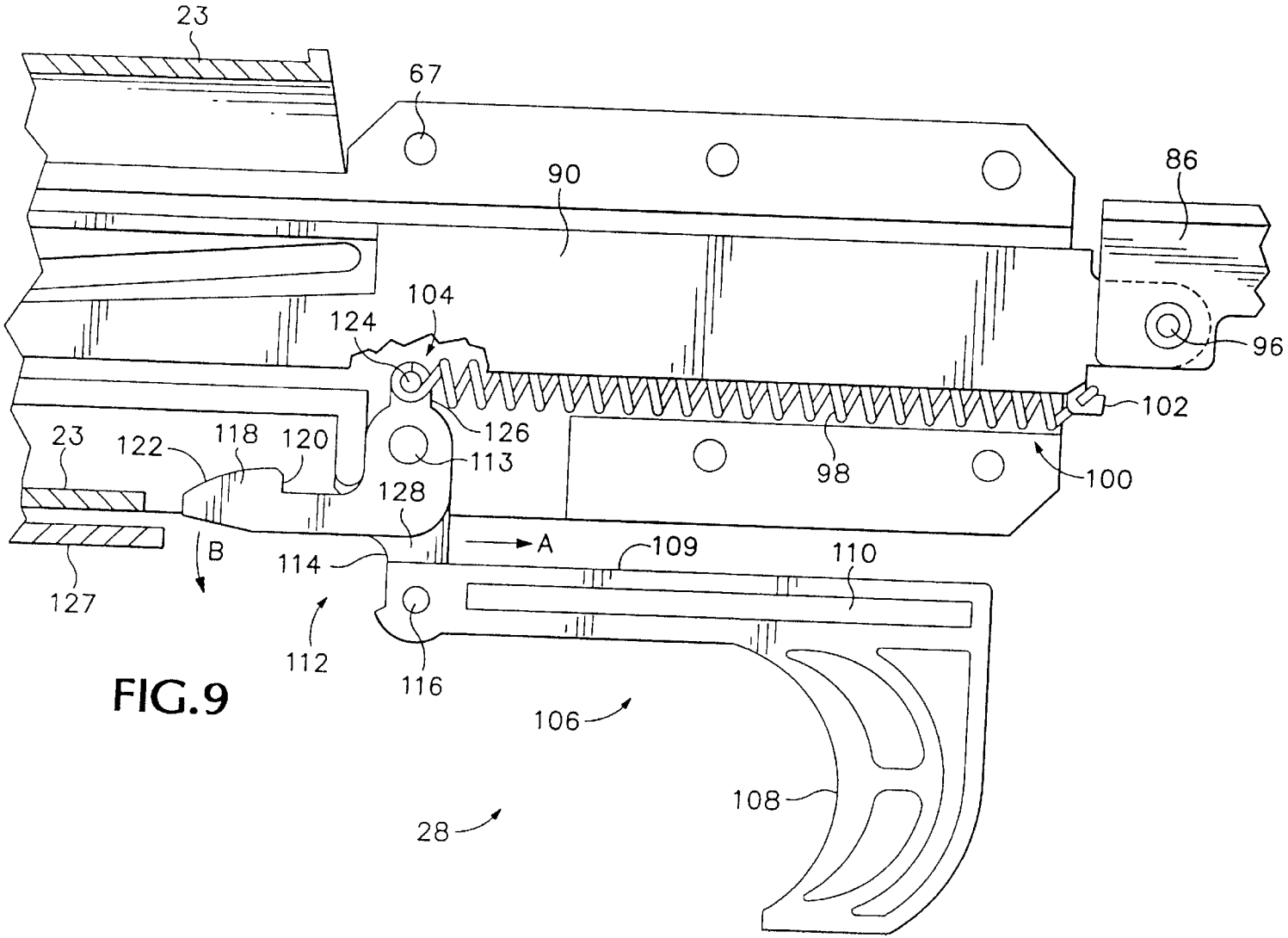
FIG. 9 is a second cross-sectional view of the ring airfoil launcher shown in FIG. 6, focusing on the trigger element of the launch mechanism.

First and second handle pieces 84, 90 are connected by a handle pin 96 to form a single handle or return element. This handle is operatively connected to ring airfoil support 60 and biased by a combined handle/trigger return spring 98 toward a position in which graspable pull 88 is adjacent rear sight 36. A first end 100 of handle/trigger return spring 98 is attached to a nib 102 on second handle piece 90, as shown in FIG. 9. A second end 104 of handle/trigger return spring 98 is attached to trigger 28, as described below.

Trigger 28 secures the launcher in a launch-ready, engaged configuration. More specifically, trigger 28 holds ring airfoil support 60 in the first, cocked position, in which energy is stored in the launcher, and releases ring airfoil support 60 upon actuation of the trigger to permit the ring airfoil support to move along member 58 to the second, fired position, in which energy is transferred to the ring airfoil. Trigger 28 is best seen in FIG. 9.

Trigger 28 is formed of two pieces, which can move relative to one another. A first, sliding piece 106 of trigger 28 contains an arcuate tongue 108 attached to an elongate bar 109. The long axis of bar 109 is approximately perpendicular to arcuate tongue 108 and is approximately parallel to the long axis of launcher 20 when sliding piece 106 is mounted. Slots 110 on both sides of elongate bar 109 interact with pins in the housing so that sliding piece 106 can slide approximately parallel to the long axis of the bar.

A second, hinged piece 112 of trigger 28 contains three flanges and is mounted pivotally to member 58 by a pin 113. A first flange 114 connects hinged piece 112 to sliding piece 106 via a pivot pin 116, such that the two pieces can pivot about a common axis. A second flange 118 engages ring airfoil support 60 when launcher 20 is in the cocked configuration. Second flange 118 contains an edge 120 for holding the ring airfoil support and may be sloped along a leading edge 122 to facilitate sliding the ring airfoil support into the engaged position. A projection 124 on third flange 126 engages second end 104 of handle/trigger return spring 98, which biases both sliding piece 106 and hinged piece 112 toward their cocked configurations. First end 100 of handle/trigger return spring 98 attaches to the handle, as described above.

Window 23 and muzzle 32 are components of the housing and may substantially enclose the member and ring airfoil support between the first and second positions. These components are best seen in FIGS. 6 and 7. Both components are roughly cylindrical and substantially encircle member 58. Muzzle 32 includes an elongate muzzle extension 127 employed in loading the launcher, as described below. Muzzle extension 127 extends from beneath muzzle 32 toward butt 26 and less generally below window 23. Muzzle 32 also may be movable relative to the member so that the ring airfoil may be more easily loaded onto ring airfoil support 60. Window 23 may be at least partially transparent to permit visual determination of whether the launcher is loaded or whether the ring airfoil support is in a selected one of the first and second positions, without looking down the nose of the launcher into the launch mechanism.

FIGS. 6, 7, and 9 show in detail how launcher 20 is loaded. To load the launcher, a user grasps muzzle 32 and/or front sight 30 and pulls muzzle 32 rearward away from nose 22 and over window 23 against resistance offered by a muzzle return spring 126. This action exposes a portion of ring airfoil support 60 and causes muzzle extension 127 to slide into a gap 128 in trigger 38. Muzzle extension 127 prevents the trigger from launching the ring airfoil support by preventing hinged trigger piece 112 from moving far enough to disengage tab 70 on the ring airfoil support when the trigger is squeezed. However, muzzle extension 127 enables the trigger to hold muzzle 32 in the rearward position by frictionally engaging hinged trigger piece 112 as long as the trigger is squeezed. With the muzzle pulled rearward, ring airfoil 200 is slipped over nose 22 and bumper 64, and placed in contact with ring airfoil support 60. Nose 22 may be tapered to facilitate loading the ring airfoil. Muzzle 32 is released from its locked position by releasing trigger 38; the muzzle then is urged back to its initial configuration by muzzle return spring 126.

FIGS. 10 and 12 show in detail how launcher 20 is cocked and fired. To cock the launcher, a user grasps handle 34 and pulls it away from nose 22. Forward edge 94 of second handle piece 90 contacts pin 78 through ring airfoil support 60 to pull the pin and the ring airfoil support along member 58 until tab 70 is engaged and held by edge 120 of trigger 28. To fire the launcher, a user pulls arcuate tongue 108 with a finger, causing elongate bar 109 to move along the long axis of the launcher, as indicated by arrow A in FIG. 9. This pulls first flange 114 in the same direction, causing second flange 118 to rotate away from and release ring airfoil support 60, as indicated by arrow B. The trigger returns to its pre-firing configuration under the influence of handle/trigger return spring 98 after arcuate tongue 108 is released.

After ring airfoil support 60 is released by trigger 28, propelling element 62 pulls the ring airfoil support from the first to the second position along a path dictated by channel 68. In launcher 20, the helical path of channel 68 interacts with ring airfoil support 60 to cause the ring airfoil support to spin as it moves along the member. Contact between the ring airfoil support and the ring airfoil causes the ring airfoil to move and spin with the ring airfoil support as the ring airfoil support moves and spins. This contact is overcome as the ring airfoil support decelerates at the second position, causing the ring airfoil to be launched with forward and spinning motion.

Launcher 20 may be constructed to be largely incapable of launching "improvised projectiles," such as paper clips, pen caps, coins, toothpicks, bottle caps, marbles, pencils, pens, pebbles, erasers, or nails. Such safety features serve both to discourage malicious use of the launcher and to prevent accidents if objects are inserted into the launcher. The safety features discussed below are best seen in FIGS. 8 and 13–15. In launcher 20, an annular muzzle insert 129 adjacent muzzle 32 and an annular bumper insert 130 adjacent bumper 58 together form a substantially uniform annular aperture 132 that limits the dimensions of potential projectiles to those of the aperture. In addition, muzzle insert 129 and bumper insert 130 are composed of soft, tacky materials which grip objects that contact the aperture. Moreover, a trailing flap 134 of material on muzzle insert 129 can curl toward the aperture and double over upon itself to bind further unintended projectiles. Furthermore, the ring airfoil support may be constructed to have no surfaces that can catch and propel improvised projectiles. For example, ring airfoil support 300 eliminates surface 76 in ring airfoil support 60 and adds a helical rib 372*a* that runs in front of and deflects improvised projectiles away from tab 370. Together, these features are sufficient to prevent the launcher from being used for most improvised projectiles.

Launcher 20 also may be constructed to determine the spin rate, kinetic energy, and kinetic energy density of launched ring airfoils. For example, the spin rate $\omega$ of ring airfoil support 64 is given by the expression $\omega=\theta/t$, where $\theta$ is the number of revolutions that occur during a time t. Thus, if the channel makes a quarter of a turn, and the ring airfoil support takes one two-thousandths of a minute (three one-hundredths of a second) to make that quarter turn, the spin rate of the ring airfoil support will be $\omega=(\frac{1}{4}\text{ revolution})/(\frac{1}{2000}\text{ minute})=500$ revolutions per minute. The spin rate of the ring airfoil at launching will be no greater than the spin rate of the ring airfoil launcher, and may be less if energy is lost overcoming frictional coupling between the ring airfoil and ring airfoil support. In launcher 20, the spin rate of the ring airfoil may be limited to be no more than 2,000 revolutions per minute, or other values, through appropriate selection of $\theta$ and t, i.e., through appropriate selection of the pitch of channel 68 and the "strength" of propelling element 62.

The kinetic energy $E_{KE}$ of the ring airfoil is given by the expression $E_{KE}=\frac{1}{2}mv^2$, where m is the mass of the ring airfoil, and v is the forward velocity of the ring airfoil. Thus, if the ring airfoil has a mass of 4 grams and a forward velocity of 16 meters per second, its kinetic energy at launching will be about 0.5 joules, where a joule is a kilogram meter per second squared. For reference, 0.5 joules is equal to the energy of a penny dropped from a height of about 20 meters, neglecting air resistance. The kinetic energy of the ring airfoil at launching may be limited to be no more than 1.0 joule, or other values, through appropriate selection of m or v, i.e., through appropriate selection of the mass of the ring airfoil and the strength of propelling element 62. The precise limit may be determined by safety standards, such as ASTM and EN71, which limit the kinetic energy of toys launched from triggered launchers to 0.5 joules.

The kinetic energy density of the ring airfoil upon impact is given by the expression $D_{KE}=E_{KE}/A$, where $E_{KE}$ is the kinetic energy of the ring airfoil as defined above, and A is the area of the region contacted by the ring airfoil. Thus, if the ring airfoil has a kinetic energy of 0.5 joules, and contacts a target over an area of $3.125\times10^{-4}$ square meters, the kinetic energy density of the ring airfoil upon impact will be 1,600 joules per square meter. The indicated area corresponds to a circle with a diameter of 0.02 meters. The kinetic energy of the ring airfoil at point-blank impact may be limited to be no more than 3,000 joules per square meter, or other values, through appropriate selection of $E_{KE}$ or A. The area A is determined by the size and flexibility of the ring airfoil. The precise limit may be determined by safety standards, such as ASTM and EN71, which limit the kinetic energy density of toys launched from triggered launchers to 1,600 joules per square meter.

The present invention also reveals methods of launching a ring airfoil that generally comprise providing a ring airfoil launcher configured to accommodate the ring airfoil, loading the ring airfoil onto the ring airfoil launcher so that the inner surface of the ring airfoil contacts the ring airfoil launcher, storing energy in the ring airfoil launcher, and transferring at least a portion of the energy stored in the ring airfoil launcher to the ring airfoil, causing the ring airfoil to be launched from the ring airfoil launcher with forward motion. The step of storing energy further may include pulling a handle. The step of transferring energy may cause the ring airfoil to be launched with both forward and gyro-stabilizing spinning motion about an axis substantially parallel to the direction of forward motion. In addition, the methods further may comprise the steps of engaging a trigger to hold the ring airfoil launcher in a first configuration, in which energy is stored, and releasing the trigger to permit the ring airfoil launcher to relax to a second configuration and transfer energy to the ring airfoil.

As an additional aspect of the invention, steps of the methods may be chosen so that the characteristics of the ring airfoil at launch are within the safety limitations discussed above. These steps may include selecting the initial forward velocity of the ring airfoil so that its kinetic energy at launching is no more than 1.0 joules, or its kinetic energy density upon point-blank impact is no more than 3,000 joules per square meter. These steps also may include selecting the initial spinning velocity of the ring airfoil so that its spin rate is no more than 2,000 revolutions per minute. These steps also may include selecting a ring airfoil with a durometer reading of no more than 80 on the Shore A scale, a mass of no more than 7.5 grams, or an outer diameter of no less than 1.5 inches.

Accordingly, while the present invention has been shown and described with reference to the foregoing preferred devices and methods for its use, it will be apparent to those skilled in the art that other changes in form and detail may be made therein without departing from the spirit and scope of the invention as defined in the appended claims.

We claim:

1. A toy for launching a ring airfoil, the toy comprising:

a member;

a ring airfoil support mounted on the member, the ring airfoil support adapted to contact the ring airfoil;

a propelling element configured to move the ring airfoil support along the member from a first position to a second position; and a return element configured to move the ring airfoil support along the member from the second position to the first position;

wherein the contact between the ring airfoil support and the ring airfoil causes the ring airfoil to move with the ring airfoil support as the ring airfoil support moves, and wherein the contact is overcome as the ring airfoil support decelerates at the second position, causing the ring airfoil to be launched with forward motion.

2. The toy of claim 1, wherein the ring airfoil has an inner surface and the ring airfoil support has a first support structure adapted to contact the inner surface.

3. The toy of claim 2, wherein the ring airfoil is flexible, and the contact between the inner surface and the first support structure maintains the ring airfoil in a substantially symmetric configuration.

4. The toy of claim 2, wherein the first support structure includes ribs extending outwardly from an axis connecting the first and second positions, and where at least one of the ribs includes a leading end, and that leading end is sloped to facilitate loading the ring airfoil on the ring airfoil support.

5. The toy of claim 1, wherein the ring airfoil has a trailing edge and the ring airfoil support has a second support structure adapted to contact the trailing edge of the ring airfoil to prevent the ring airfoil from sliding off the ring airfoil support during launching.

6. The toy of claim 5, wherein the second support structure includes a surface oriented substantially perpendicular to an axis connecting the first and second positions.

7. The toy of claim 1, wherein the return element is separate from the ring airfoil support.

8. The toy of claim 1, further comprising a housing which substantially encloses the member and ring airfoil support between the first and second positions.

9. The toy of claim 8, wherein at least a portion of the housing is movable relative to the member so that the ring airfoil may be more easily loaded onto the ring airfoil support.

10. The toy of claim 8, wherein the housing is constructed to permit visual determination of whether the ring airfoil support is in a selected one of the first and second positions.

11. The toy of claim 1, further comprising a trigger to hold the ring airfoil support in the first position, and to release the ring airfoil support to permit the ring airfoil support to move along the member to the second position.

12. The toy of claim 1, wherein the propelling element also causes the ring airfoil support to spin as it moves, such that the contact between the ring airfoil support and ring airfoil causes the ring airfoil both to move and spin with the ring airfoil support as the ring airfoil support moves and spins, and wherein the contact is overcome when the ring airfoil support decelerates at the second position, causing the ring airfoil to be launched with forward and spinning motion.

13. The toy of claim 1, wherein the member has a channel disposed along at least a portion of its length, the propelling element causing the ring airfoil support to interact with the channel to cause the ring airfoil support to spin as it moves between the first and second positions.

14. The toy of claim 13, wherein the portion of the member between the first and second positions is substantially cylindrical, and wherein the ring airfoil support has an aperture through which the member is received, the ring airfoil support riding on the member between the first and second positions.

15. The toy of claim 14, wherein the channel extends helically about the member, and further comprising a pin which projects through the ring airfoil support, channel and propelling element to hold the ring airfoil support on the member and to cause the ring airfoil support to spin when it travels from the first position to the second position.

16. The toy of claim 15, wherein the propelling element includes a spring having two ends, wherein one end is attached to the member and the other end is attached to the pin to cause movement of the ring airfoil support from the first position to the second position.

17. The toy of claim 1, further comprising a safety element configured to limit the ability of the launcher to launch non-ring-airfoil projectiles.

18. The toy of claim 1, further comprising a safety element configured to limit the ability of the launcher to launch projectiles other than the ring airfoil projectile.

19. A toy for launching a projectile, the toy comprising:

a member;

a projectile support mounted on the member;

a propelling element associated with the projectile support and configured to move the projectile support along the member from a first position to a second position;

a channel in the member which interacts with the projectile support to cause the projectile support to spin as it moves from the first position to the second position; and a movable handle having a grip surface, operatively connected to the projectile support, where movement of the handle causes movement of the projectile support along the member from the second position to the first position.

20. The toy of claim 19 further comprising a housing substantially enclosing the member and projectile support between the first and second positions.

21. The toy of claim 20, wherein at least a portion of the housing is movable relative to the member so that the projectile may be more easily loaded onto the projectile support.

22. The toy of claim 20, wherein the housing is constructed to permit visual determination of whether the projectile support is in the first position.

23. The toy of claim 19, further comprising a trigger to hold the projectile support in the first position, and to release the projectile support to permit the projectile support to move along the member to the second position.

24. The toy of claim 19, wherein the projectile support is configured to engage a projectile having a cylindrical aperture.

25. The toy of claim 19, wherein the portion of the member between the first and second positions is substantially cylindrical, and wherein the projectile support has an aperture through which the member is received, the projectile support riding on the member between the first and second positions.

26. The toy of claim 19, wherein the channel extends helically about the member, and further comprising a pin which projects through the projectile support, channel and propelling element to hold the projectile support on the member and to cause the projectile support to spin as it travels from the first position to the second position.

27. The toy of claim 26, wherein the propelling element includes a spring having two ends, wherein one end is attached to the member and the other end is attached to the pin to cause movement of the projectile support from the first position to the second position.

28. A toy for launching a projectile, the toy comprising:

a member;

a projectile support mounted on the member;

a propelling element associated with the projectile support and configured to move the projectile support along the member from a first position to a second position; a channel in the member which interacts with the projectile support to cause the projectile support to spin as it moves from the first position to the second position;

a return element configured to move the projectile support along the member from the second position to the first position; and a housing substantially enclosing the member and projectile support between the first and second positions.

29. The toy of claim 28, wherein at least a portion of the housing is movable relative to the member so that the projectile may be more easily loaded onto the projectile support.

30. The toy of claim 28, wherein the housing is constructed to permit visual determination of whether the projectile support is in the first position.

31. The toy of claim 28, wherein the return element is separate from the projectile support.

32. The toy of claim 28, further comprising a tigger to hold the projectile support in the first position, and to release the projectile support to permit it to move along the member to the second position.

33. The toy of claim 28, wherein the projectile support is configured to engage a flying projectile having a cylindrical aperture.

34. The toy of claim 33, wherein the portion of the member between the first and second positions is substantially cylindrical, and wherein the projectile support has an aperture through which the member is received, the projectile support riding on the member between the first and second positions.

35. The toy of claim 34, wherein the channel extends helically about the member, and further comprising a pin which projects through the projectile support, channel and propelling element to hold the projectile support on the member and to cause the projectile support to spin as it travels from the first position to the second position.

36. The toy of claim 35, wherein the propelling element includes a spring having two ends, wherein one end is attached to the member and the other end is attached to the pin to cause movement of the projectile support from the first position to the second position.

37. A toy for launching a ring airfoil, the toy comprising:

a ring airfoil support adapted to contact the ring airfoil;

a return element configured to move the ring airfoil support from a fired position to a cocked position; and a propelling element configured to accelerate and decelerate the ring airfoil support, wherein the contact between the ring airfoil support and the ring airfoil causes the ring airfoil to accelerate with the ring airfoil support as the ring airfoil support accelerates, and wherein the contact is overcome as the ring airfoil support decelerates, causing the ring airfoil to be launched from the ring airfoil support with forward motion;

wherein the propelling element is selected so that the kinetic energy associated with the forward motion of the ring airfoil at launching is no more than 1.0 joule.

38. The toy of claim 37, wherein the propelling element is selected so that the kinetic energy density of the ring airfoil at point-blank impact is no more than 3,000 joules per square meter.

39. The toy of claim 37, wherein as the ring airfoil support decelerates, the ring airfoil is launched from the ring airfoil support with both forward and spinning motions; and wherein the propelling element is selected so that the spin rate of the ring airfoil is no more than 2,000 revolutions per minute.

40. The toy of claim 37, where the ring airfoil has an inner surface, and wherein the ring airfoil support is adapted to contact the inner surface so that flexible ring airfoils having a durometer reading of no more than 80 on the Shore A scale may be maintained in a substantially symmetric configuration.

41. The toy of claim 37, where the ring airfoil has an inner surface, and wherein the ring airfoil support is adapted to prevent contact between the ring airfoil support and the inner surface when the ring airfoil has an outer diameter of less than 1.5 inches.

42. A toy for launching a predetermined projectile, the toy comprising:

a member;

a projectile support mounted on the member;

a propelling element associated with the projectile support and configured to move the projectile support along the member from a first position to a second position;

a channel in the member which interacts with the projectile support to cause the projectile support to spin as it moves from the first position to the second position;

a housing adjacent the member; and a safety element configured to limit the ability of the launcher to launch projectiles other than the predetermined projectile, wherein at least a portion of the safety element extends toward the member from the housing.

43. The toy of claim 42, wherein the safety element includes an aperture through which the projectile must pass, and wherein the aperture has dimensions, the dimensions of the aperture serving to limit the dimensions of the projectile.

44. The toy of claim 42, wherein the safety element includes at least a portion comprising tacky material.

45. The toy of claim 42, wherein the safety element includes a flap configured to restrict the launching of projectiles other than the predetermined projectile.

46. The toy of claim 45, wherein the flap is configured to double over upon itself.

47. A method for launching a ring airfoil, where the ring airfoil has an inner surface, the method comprising:

providing a ring airfoil launcher configured to accommodate the ring airfoil;

loading the ring airfoil onto the ring airfoil launcher so that the inner surface of the ring airfoil contacts the ring airfoil launcher;

storing elastic energy in the ring airfoil launcher; and transferring at least a portion of the energy stored in the ring airfoil launcher to the ring airfoil, causing the ring airfoil to be launched from the ring airfoil launcher with forward motion.

48. The method of claim 47, wherein the step of transferring energy causes the ring airfoil to be launched from the ring airfoil launcher with both forward and spinning motion, the spinning motion occurring about an axis substantially parallel to the direction of forward motion.

49. The method of claim 47, wherein the step of storing energy includes pulling a handle.

50. The method of claim 47, further comprising:

engaging a trigger to hold the ring airfoil launcher in a first configuration, in which energy is stored; and releasing the trigger to permit the ring airfoil launcher to relax to a second configuration and transfer energy to the ring airfoil.

51. The method of claim 50, wherein the step of storing energy includes pulling a handle to convert the ring airfoil launcher from the first configuration to the second configuration.

52. The method of claim 47, wherein the elastic energy is stored in a spring.

53. A toy for launching a ring airfoil, where the ring airfoil has an inner surface, the toy comprising:

a member;

a ring airfoil support mounted on the member, the ring airfoil support having a support structure adapted to contact the inner surface of the ring airfoil; and a propelling element configured to move the ring airfoil support along the member from a first position to a second position;

wherein the support structure includes ribs extending outwardly from an axis connecting the first and second positions, and where at least one of the ribs includes a leading end, and that leading end is sloped to facilitate loading the ring airfoil on the ring airfoil support; and wherein the contact between the ring airfoil support and the ring airfoil causes the ring airfoil to move with the ring airfoil support as the ring airfoil support moves, and wherein the contact is overcome as the ring airfoil support decelerates at the second position, causing the ring airfoil to be launched with forward motion.

54. A toy for launching a ring airfoil, the toy comprising:

a member;

a ring airfoil support mounted on the member, the ring airfoil support adapted to contact the ring airfoil;

a propelling element configured to move the ring airfoil support along the member from a first position to a second position; and a trigger to hold the ring airfoil support in the first position, and to release the ring airfoil support to permit the ring airfoil support to move along the member to the second position;

wherein the contact between the ring airfoil support and the ring airfoil causes the ring airfoil to move with the ring airfoil support as the ring airfoil support moves, and wherein the contact is overcome as the ring airfoil support decelerates at the second position, causing the ring airfoil to be launched with forward motion.

55. A toy for launching a projectile, the toy comprising:

a member;

a projectile support mounted on the member;

a propelling element associated with the projectile support and configured to move the projectile support along the member from a first position to a second position;

a channel in the member which interacts with the projectile support to cause the projectile support to spin as it moves from the first position to the second position;

a trigger to hold the projectile support in the first position, and to release the projectile support to permit it to move along the member to the second position; and a housing substantially enclosing the member and projectile support between the first and second positions.

56. A toy for launching a projectile, the toy comprising:

a member;

a projectile support mounted on the member;

an elastic propelling element associated with the projectile support and configured to move the projectile support along the member from a first position to a second position;

a channel in the member which interacts with the projectile support to cause the projectile support to spin as it moves from the first position to the second position; and a housing substantially enclosing the member and projectile support between the first and second positions.

57. The toy of claim 56, wherein the elastic propelling element includes a spring.

58. A toy for launching a predetermined projectile, the toy comprising:

a member;

a projectile support mounted on the member;

a propelling element associated with the projectile support and configured to move the projectile support along the member from a first position to a second position;

a channel in the member which interacts with the projectile support to cause the projectile support to spin as it moves from the first position to the second position; and a safety element configured to limit the ability of the launcher to launch projectiles other than the predetermined projectile, wherein the safety element includes an aperture through which the projectile must pass, and wherein the aperture has dimensions, the dimensions of the aperture serving to limit the dimensions of the projectile.

59. A toy for launching a predetermined projectile, the toy comprising:

a member;

a projectile support mounted on the member;

a propelling element associated with the projectile support and configured to move the projectile support along the member from a first position to a second position;

a channel in the member which interacts with the projectile support to cause the projectile support to spin as it moves from the first position to the second position; and a safety element configured to limit the ability of the launcher to launch projectiles other than the predetermined projectile, wherein the safety element includes at least a portion comprising tacky material.

60. A toy for launching a predetermined projectile, the toy comprising:

a member;

a projectile support mounted on the member;

a propelling element associated with the projectile support and configured to move the projectile support along the member from a first position to a second position; a channel in the member which interacts with the projectile support to cause the projectile support to spin as it moves from the first position to the second position; and a safety element configured to limit the ability of the launcher to launch projectiles other than the predetermined projectile, wherein the safety element includes a flap configured to restrict the launching of projectiles other than the predetermined projectile.

61. The toy of claim 60, wherein the flap is configured to double over upon itself.

62. A method for launching a ring airfoil, where the ring airfoil has an inner surface, the method comprising:

providing a ring airfoil launcher configured to accommodate the ring airfoil;

loading the ring airfoil onto the ring airfoil launcher so that the inner surface of the ring airfoil contacts the ring airfoil launcher;

storing energy in the ring airfoil launcher; and transferring at least a portion of the energy stored in the ring airfoil launcher to the ring airfoil, causing the ring airfoil to be launched from the ring airfoil launcher with forward motion;

wherein the step of storing energy includes pulling a handle; and wherein the step of transferring energy causes the ring airfoil to be launched from the ring airfoil launcher with both forward and spinning motion, the spinning motion occurring about an axis substantially parallel to the direction of forward motion.

63. A method for launching a ring airfoil, where the ring airfoil has an inner surface, the method comprising:

providing a ring airfoil launcher configured to accommodate the ring airfoil;

loading the ring airfoil onto the ring airfoil launcher so that the inner surface of the ring airfoil contacts the ring airfoil launcher;

storing energy in the ring airfoil launcher;

engaging a trigger to hold the ring airfoil launcher in a first configuration, in which the energy is stored;

releasing the trigger to permit the ring airfoil launcher to relax to a second configuration, in which the energy is transferred; and transferring at least a portion of the energy stored in the ring airfoil launcher to the ring airfoil, causing the ring airfoil to be launched from the ring airfoil launcher with forward motion;

wherein the step of transferring energy causes the ring airfoil to be launched from the ring airfoil launcher with both forward and spinning motion, the spinning motion occurring about an axis substantially parallel to the direction of forward motion.

64. The method of claim 63, wherein the step of storing energy includes pulling a handle.

* * * * *